United States Patent [19]

Courson

[11] Patent Number: 4,669,132

[45] Date of Patent: Jun. 2, 1987

[54] COSMETOLOGIST'S PROTECTIVE DEVICE

[76] Inventor: Barbara A. Courson, 759 Harcourt, Grosse Pointe, Mich. 48230

[21] Appl. No.: 902,688

[22] Filed: Sep. 2, 1986

[51] Int. Cl.[4] ..... A45D 44/10

[52] U.S. Cl. ..... 4/523; 4/515; 4/519; 4/575

[58] Field of Search ..... 4/515, 516, 517, 519, 4/520, 522, 523, 575; 297/397, 399

[56] References Cited

U.S. PATENT DOCUMENTS

| | | | |
|---|---|---|---|
| 2,297,639 | 9/1942 | Thauwald | 4/520 |
| 2,948,903 | 8/1960 | Gilmar | 4/523 |
| 3,035,279 | 5/1962 | Stead | 4/575 X |
| 3,078,474 | 2/1963 | Chaitlen | 4/575 |
| 4,411,032 | 10/1983 | Lewy | 4/515 |

*Primary Examiner*—Henry K. Artis
*Attorney, Agent, or Firm*—William L. Fisher

[57] ABSTRACT

A cosmetologist's protective device comprising a preformed disposable object having an open-ended tapered cavity therein so that a plurality of such devices can be stacked, one on top of the other, the device having a top wall and two side walls depending from the top wall, the top wall of the device being concavo-convex in transverse cross-section and an arrangement on the underneath surface thereof for adhering the device to a beauty salon shampoo sink to cover the cutaway portion in the front wall thereof, whereby a germ-free cushioned surface is provided for supporting the neck of a customer.

5 Claims, 6 Drawing Figures

COSMETOLOGIST'S PROTECTIVE DEVICE

SPECIFICATION

My invention relates to cosmetology and has for its object the provision of a cosmetologist's protective device.

The foregoing object of my invention, and the advantages thereof, will become apparent during the course of the following description, taken in conjunction with the accompanying drawings, in which.

Figure 1:
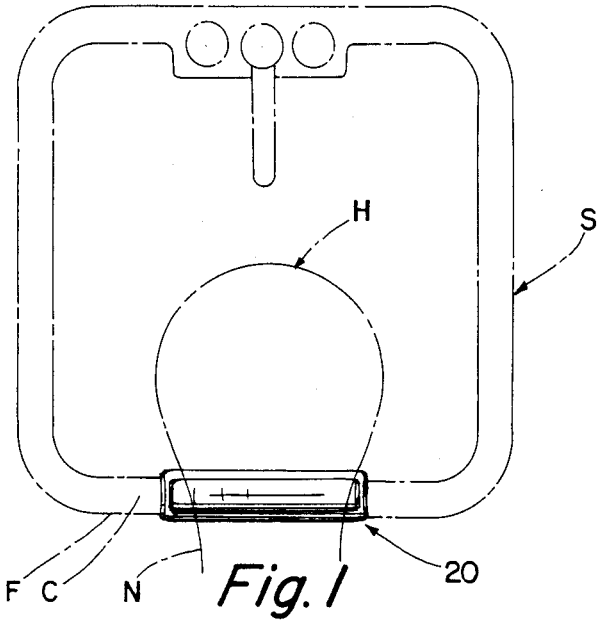
FIGS. 1 and 2 are, respectively, top plan and front elevational views of a cosmetologist's protective device embodying my invention and shown in use on a beauty salon shampoo sink.

Referring to the drawings in greater detail, 20 generally designates said cosmetologist's protective device which comprises a pre-formed disposable object having an open-ended tapered cavity 22 therein so that a plurality of such devices can be stacked,one on top of the other. The cosmetologist's protective device 20 has a top wall and two side walls depending from the top wall. The top wall is concavo-convex in transverse cross-section, as shown, and has means on the underneath surface thereof for adhering the device to a beauty salon type sink "S" to cover the cutaway portion "C" in the front wall "F" thereof. The side walls taper outwardly as they extend downwardly as shown in FIG. 3.

Figure 3:
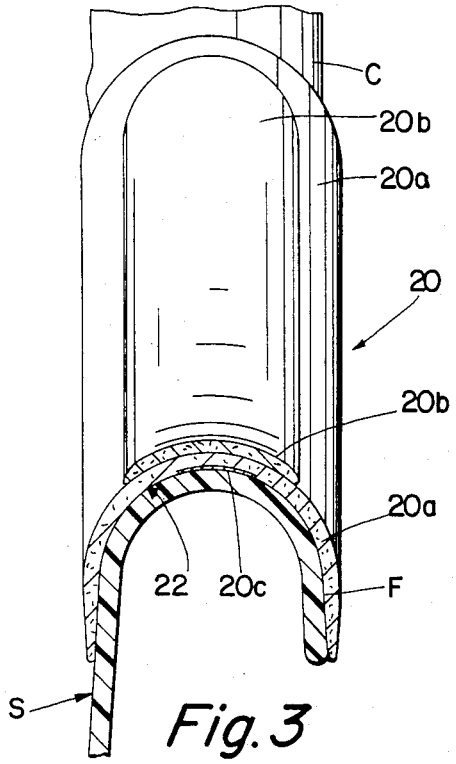
FIG. 3 is a vertical sectional view of a portion of the structure of FIG. 1 taken on the line 3—3 thereof.
Figure 2:
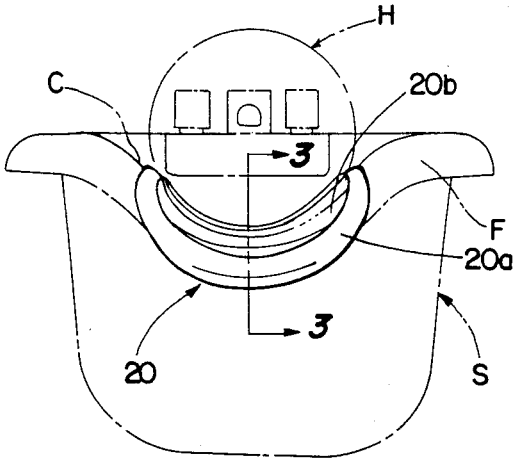
Figure 6:
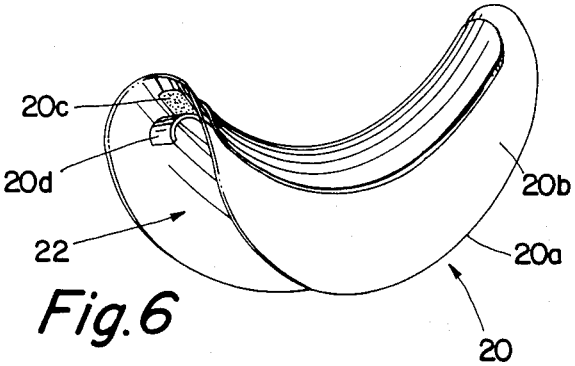
FIG. 6 is a perspective view of said cosmetologist's protective device.
Figure 4:
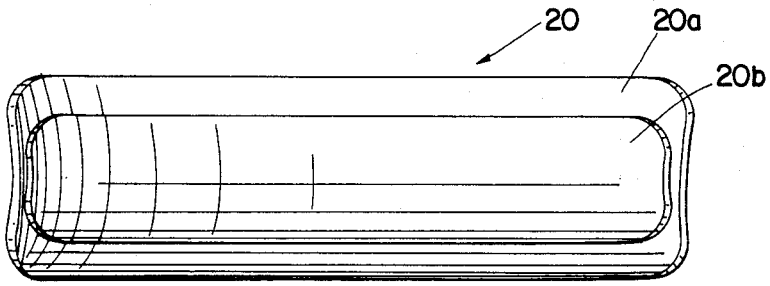
FIGS. 4 and 5 are, respectively, top and bottom plan views of said cosmetologist's protective device.
Figure 5:
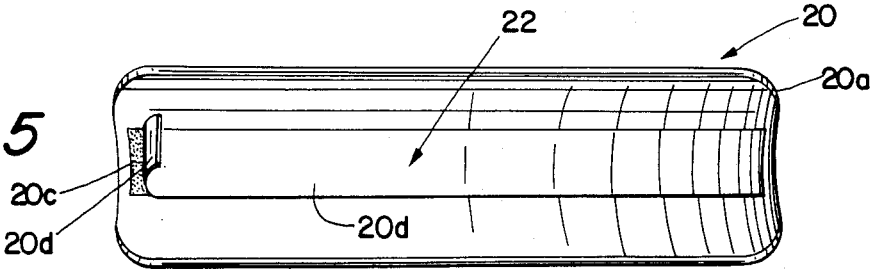

A germ-free cushioned surface is thus provided for supporting the neck of a customer as shown in FIGS. 2 and 3 wherein the head "H" and neck "N" of a customer are shown disposed in supine position in the sink "S" for shampooing of the hair with the back of the neck supported on the cosmetologist's protective device 20. Preferably, the device is fabricated of fibrous paper. An example of a well known product made of such fibrous paper are disposable face masks which fit against the face to cover the nose and mouth and are held thereon by an elastic strap. 3M Company of Minneapolis, Minnesota is a manufacturer of such masks which are used in hospitals to protect exhaling and in other places to protect inhaling such as paint booths. Preferably,the device 20 is made in two layers which are fused together as by carding or adhesive or a combination thereof during the manufacturing process to form a unitary object. The two layers are designated 20*a* and 20*b*, being the bottom and top layers, respectively. The top layer 20*b* extends principally over the top wall only of the bottom layer 20*a*. In front elevational view, the front and rear walls of the device 20 are generally crescent-shaped. The underside of the top wall of the device 20 is provided with a longitudinal strip 20*c* of pressure-sensitve adhesive, preferably of the wet-stick type; said strip 20*c* being applied during the manufacturing process to the underside surface of layer 20*a* and being covered, until use, with a peel-off tape 20*d*.

In use of the device 20, the user simply removes one thereof from a stack of such devices and peels off the tape 20*d* and adheres the device 20 to the cutaway portion "C" via the adhesive strip 20*c*. The customer can now rest the back of his or her neck "N" on the covered cutaway portion "C" with complete assurance that same will rest upon a dry, cushioned and germ-free surface.

It will thus be seen that there has been provided by my invention a cosmetologist's protective device in which the object hereinabove set forth, together with many thoroughly practical advantages, has been successfully achieved. While a preferred embodiment of my invention has been shown and described, it is to be understood that variations and changes may be restored to without departing from the spirit of my invention as defined by the appended claims.

What I claim is:

1. A cosmetologist's protective device comprising a pre-formed disposable object having an open-ended tapered cavity therein so that a plurality of such devices can be stacked, one on top of the other, said device having a top wall and two side walls depending from said top wall, the top wall of said device being concavo-convex in transverse cross-section and means on the underneath surface thereof for adhering said device to a beauty salon shampoo sink to cover the cutaway portion in the front wall thereof, whereby a germ-free cushioned surface is provided for supporting the back of the neck of a customer.

2. A cosmetologist's protective device as claimed in claim 1 further comprising said device being formed of layers which are fused together to form a single unitary object.

3. A cosmetologist's protective device as claimed in claim 2 further comprising said device being formed of two such layers.

4. A cosmetologist's protective device as claimed in claim 3 further comprising said two layers being a bottom layer and a top layer, the top layer extending over the top wall only of the bottom layer.

5. A cosmetologist's protective device as claimed in claim 4 further comprising said bottom layer being provided with an adhesive strip which extends longitudinally along the underneath surface of the top wall thereof and a peel-off tape covering said adhesive strip.

* * * * *